US005180539A

United States Patent [19]

Yoshino et al.

[11] Patent Number: 5,180,539

[45] Date of Patent: Jan. 19, 1993

[54] METHOD OF AND APPARATUS FOR PRODUCING METAL POWDER

[75] Inventors: Syoichi Yoshino; Hiroshi Izaki; Masanori Yoshino; Fumio Kasai; Yosimitu Tokunaga, all of Osaka; Naotsugu Isshiki, Tokyo, all of Japan

[73] Assignee: Kubota Corporation, Osaka, Japan

[21] Appl. No.: 672,576

[22] Filed: Mar. 20, 1991

[30] Foreign Application Priority Data

Mar. 20, 1990 [JP] Japan ..... 2-70732
May 10, 1990 [JP] Japan ..... 2-121962

[51] Int. Cl.[5] ..... C22B 9/05

[52] U.S. Cl. ..... 266/202; 425/7

[58] Field of Search ..... 266/202, 200; 425/6, 425/7

[56] References Cited

U.S. PATENT DOCUMENTS 4,177,026 12/1979 Honnorat et al. ..... 425/7
4,405,535 9/1983 Raman et al. ..... 264/11
4,824,478 4/1989 Roberts et al. ..... 425/7
4,869,469 9/1989 Bylon et al. ..... 266/202

FOREIGN PATENT DOCUMENTS 1-49769 10/1989 Japan .

*Primary Examiner*—George Wyszomerski

[57] ABSTRACT

A cooling liquid is injected into and supplied to a cooling tubular body along its inner periphery to form a cooling liquid layer flowing down the inner peripheral surface of the body while revolving. A molten metal is then injected into the cooling liquid layer from the inner peripheral side thereof to divide, rapidly cool and solidify the stream of molten metal with the cooling liquid layer and obtain a metal powder. Since the metal powder is continuously obtained upon flowing down the tubular body along with the cooling liquid, the liquid can be continuously removed from the powder by suitable means, and the power can be subsequently dried continuously.

15 Claims, 10 Drawing Sheets

METHOD OF AND APPARATUS FOR PRODUCING METAL POWDER

FIELD OF THE INVENTION

The present invention relates to an apparatus for producing a metal powder by injecting a molten metal into a cooling liquid layer moving in revolution.

DESCRIPTION OF BACKGROUND ART

Rapidly solidified metal powers are made up of fine crystal grains and can be supersaturated with alloy elements, so that the extruded material prepared, for example, from a rapidly solidified powder of aluminum or an alloy thereof is superior in characteristics to the material prepared from a molten metal and has attracted attention as a material for machine parts and the like.

The preferred methods of producing such rapidly solidified metal powders include the rotary drum method. With reference to FIG. 10 showing this method, a stream of molten metal is injected into a cooling liquid layer 62 centrifugally formed over the inner peripheral surface of a rotating cooling drum 61 to finely divide the molten metal and obtain a rapidly solidified metal powder. Indicated at 63 in the drawing is an injection crucible serving as means for injecting the molten metal and provided with a heating high-frequency coil 64 around its outer periphery and an injection nozzle 65 in the lower portion of its side wall. The crucible 63 contains the molten metal 66, which is forced out from the nozzle 65 by injecting an inert gas 67 into the crucible 63 under an increased pressure. When a predetermined amount of metal power accumulates in the cooling drum 61, the rotation of the drum 61 is stopped, and the powder is collected along with the cooling liquid, followed by removal of the liquid and drying. Examined Japanese Patent Publication HEI 1-49769 discloses such a method of producing metal powders.

However, the rotary drum method is practiced by a so-called batchwise operation and is low in productivity. Additionally, the need to discontinue the injection of molten metal for collecting the powder entails the problem that the nozzle orifice is prone to clogging.

Further to maintain a constant cooling temperature, the cooling liquid must be supplied to and discharged from the liquid surface of the cooling liquid layer for temperature control, whereas this disturbs the liquid surface and gives rise to the problem that variations are liable to occur in the particle size or quality of the powder.

Since the powder is collected along with the cooling liquid, the method has another problem in that the removal of the liquid requires a considerable period of time thus resulting in a poor efficiency. Moreover, the powder is held in contact with the cooling liquid for a prolonged period of time and therefore contains an increased amount of hydrogen, oxygen or like gas, which is likely to produce defects in the material to be obtained by extruding the powder or by heat-treating the extrudate.

OBJECT AND SUMMARY OF THE INVENTION

An object of the present invention is to provide an apparatus for producing a metal powder having a stabilized quality by a facilitated continuous operation including the step of drying the powder produced.

To practice the production method of the present invention, a cooling liquid is first injected into and supplied to a cooling tubular body along its inner periphery to form a cooling liquid layer flowing down the inner peripheral surface of the body while revolving. A molten metal is then injected into the cooling liquid layer from the inner peripheral side thereof to divide, rapidly cool and solidify the stream of molten metal with the cooling liquid layer and obtain a metal powder. Since the metal powder is continuously obtained upon flowing down the tubular body along with the cooling liquid, the liquid can be continuously removed from the powder by suitable means, and the powder can be subsequently dried continuously.

The apparatus of the present invention for continuously producing a metal powder comprises a cooling tubular body provided with a liquid injection pipe for injecting a cooling liquid into the tubular body along the inner periphery thereof from a tangential direction, injector means for injecting a molten metal into a cooling liquid layer formed over the inner peripheral surface of the tubular body by the cooling liquid injected from the liquid injection pipe, and feed means for feeding the cooling liquid to the liquid injection pipe.

According to the present invention, a cooling liquid is injected into and supplied to the cooling tubular body along the inner periphery thereof to form a cooling liquid layer flowing down the inner peripheral surface of the body while revolving, so that the liquid layer into which a molten metal is injected has a stabilized inner peripheral surface and is easily maintained at a uniform temperature. Since the molten metal is injected into this cooling liquid layer, a rapidly solidified powder having a specified quality can be prepared continuously with high productivity, with the injector means (injection nozzle) rendered free of clogging. Furthermore, the metal powder flowing down along with the cooling liquid can be continuously separated from the liquid and dried. This shortens the period of time during which the powder is in contact with the cooling liquid to reduce the gas content of the powder, serving to preclude the defects which would be produced by the gas when the powder is extruded or otherwise processed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

First, a description will be given of an apparatus for practicing the method of producing a metal powder according to the present invention.

Figure 1:
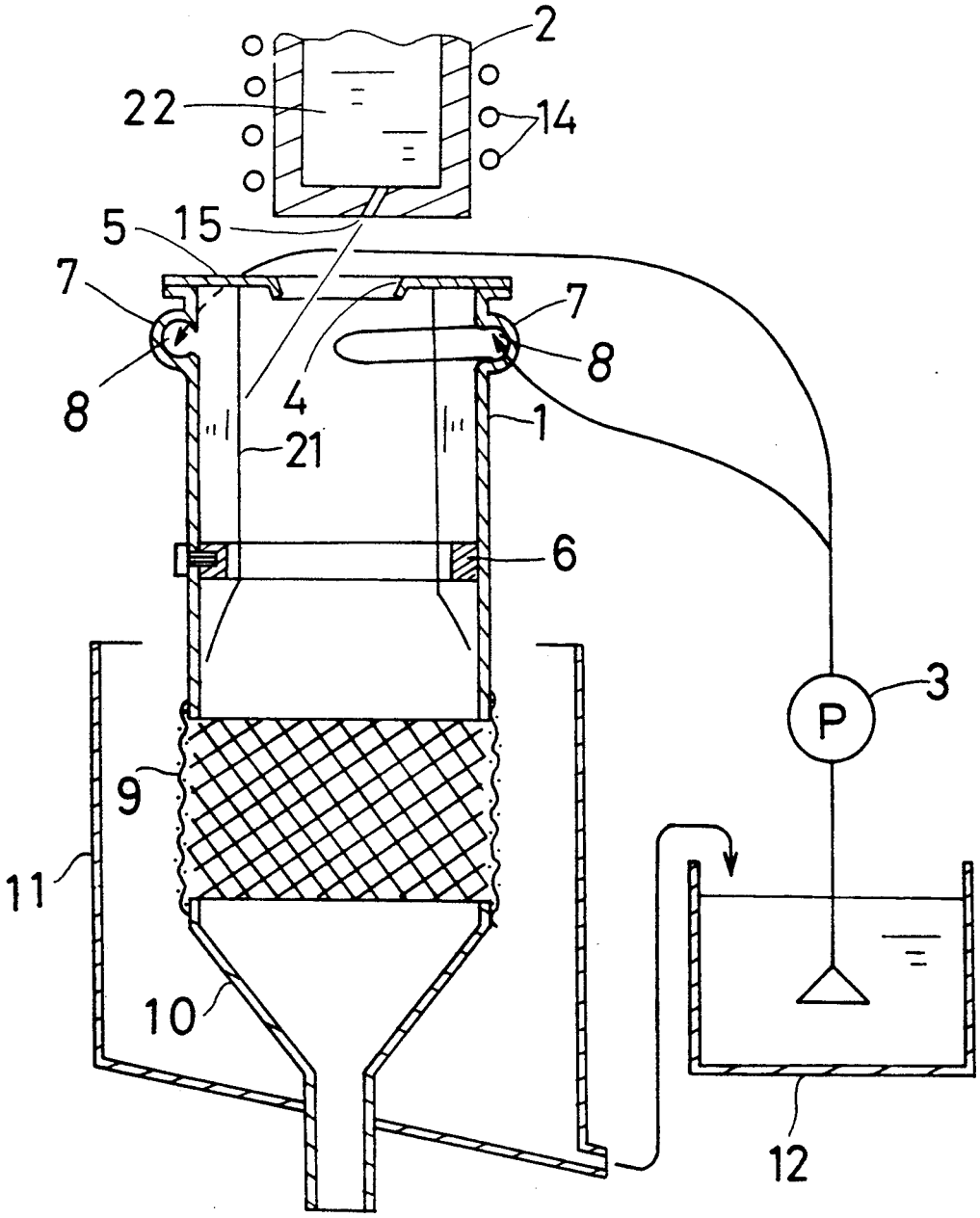
FIG. 1 is a fragmentary diagram in section of an apparatus embodying the invention for producing a metal powder.

FIG. 1 shows an embodiment of apparatus for producing a metal powder. The apparatus comprises a a cooling cylinder 1 for forming a layer 21 of cooling liquid over the inner peripheral surface thereof, an injection crucible 2 serving as means for injecting a molten metal 22 into the cooling liquid layer 21, and a pump 3 serving as means for supplying the cooling liquid to the cylinder 1.

The cylinder 1 is hollow and circular in cross section and has a closure 5 covering its top end and centrally formed with an opening 4 for supplying the molten metal to the liquid layer 21 therethrough. A ring 6 for adjusting the thickness of the cooling liquid layer 21 is removably replaceably attached to the inner periphery of the lower portion of the cylinder 1 with bolts. The outlets 8 of cooling liquid injection pipes 7 are arranged symmetrically at the upper portion of the cylinder and are opened at a plurality of locations on the inner periphery of the cylinder tangentially thereof. The axis of each injection pipe 7 is inclined at an angle of about 0 to about 20 degrees with respect to a horizontal line tangent to the cylinder inner periphery. A liquid removing net 9 in the form of a hollow cylinder is attached to the lower end of the cylinder 1 and has a powder collecting funnel 10 attached to the lower end of the net 9. A cover 11 is provided around the net 9. Although the thickness adjusting ring 6 has a rectangular cross section in the illustrated case, the ring may have a trumpet-shaped curved surface having a gradually increasing diameter from the outer periphery of its upper side toward the inner periphery of its lower side.

The liquid injection pipes 7 are connected via the pump 3 to a tank 12 by piping. The bottom of the cover 11 is also connected to the tank 12 by piping, such that the cooling liquid collected by the cover 11 is returned to the tank 12 and recycled for use. The tank 12 has a feed pipe (not illustrated) for replenishing the tank with the cooling liquid. A cooler may be provided in the tank or at an intermediate portion of the recycling channel. Although the cooling liquid is generally water, oil is usable in some cases.

The injection crucible 2 serving as the molten metal injecting means is disposed above the closure 5, and has a heating induction coil 14 wound around its outer periphery and a nozzle orifice 15 formed in its bottom. An inert gas, such as Ar or $N_2$, and molten metal are forced into the injection crucible 2, from which the molten metal 22 is injected into the cooling liquid layer 21 through the nozzle orifice 15.

To practice the present invention, the pump 3 is first operated to form a cooling liquid layer 21 flowing down the inner peripheral surface of the cylinder 1 while revolving at a high speed.

More specifically, the cooling liquid injected into the cylinder 1 along the inner periphery thereof from the injection pipes 7 flows down the inner peripheral surface of the cylinder 1 while revolving and flows over the thickness adjusting ring 6 downward. Above the ring 6, the cooling liquid forms a layer 21 of approximately uniform inside diameter under a centrifugal force then produced by the revolution.

Since the cooling liquid layer 21 is formed by the cooling liquid which is newly supplied at all times, the layer can be readily maintained at a specified temperature. Accordingly, the cooling liquid need not be supplied to and discharged from the liquid surface for temperature control, consequently giving good stability to the layer with a reduced likelihood of disturbance of the liquid surface.

Ar gas or like inert gas is then forced into the injection crucible 2 disposed above the cylinder 1, whereby the molten metal 22 in the crucible 2 is jetted against the inner surface of the cooling liquid layer 21 through the nozzle orifice 15, and divided, rapidly cooled and solidified with the revolving stream of liquid.

Thus, when the molten metal is injected into and supplied to the cooling liquid layer 21 from the inner peripheral side thereof, the stream of molten metal is divided, rapidly cooled and solidified by the revolving flow of liquid to continuously produce a metal powder. The powder is highly stabilized in quality becaused it is produced by the cooling liquid layer having a stabilized temperature and a stabilized liquid surface.

The metal powder in the cooling liquid layer 21 flows down over the thickness adjusting ring 6 while revolving along with the cooling liquid and enters the liquid removing net 9 at the lower end of the cylinder 1, whereupon the liquid is centrifugally sputtered radially outward through the net 9. The metal powder obtained has a liquid content which is reduced by the primary removal of liquid thus effected. The metal powder, which is reduced in liquid content, is treated by a liquid removing device, whereby the liquid is almost completely removed from the powder within a short period of time to render the powder easy to dry.

More specifically, the metal powder having its liquid primarily removed and discharged from the funnel 10 is treated by a centrifugal separator or like suitable liquid removing device and then dried to give a finished powder product.

Figure 2:
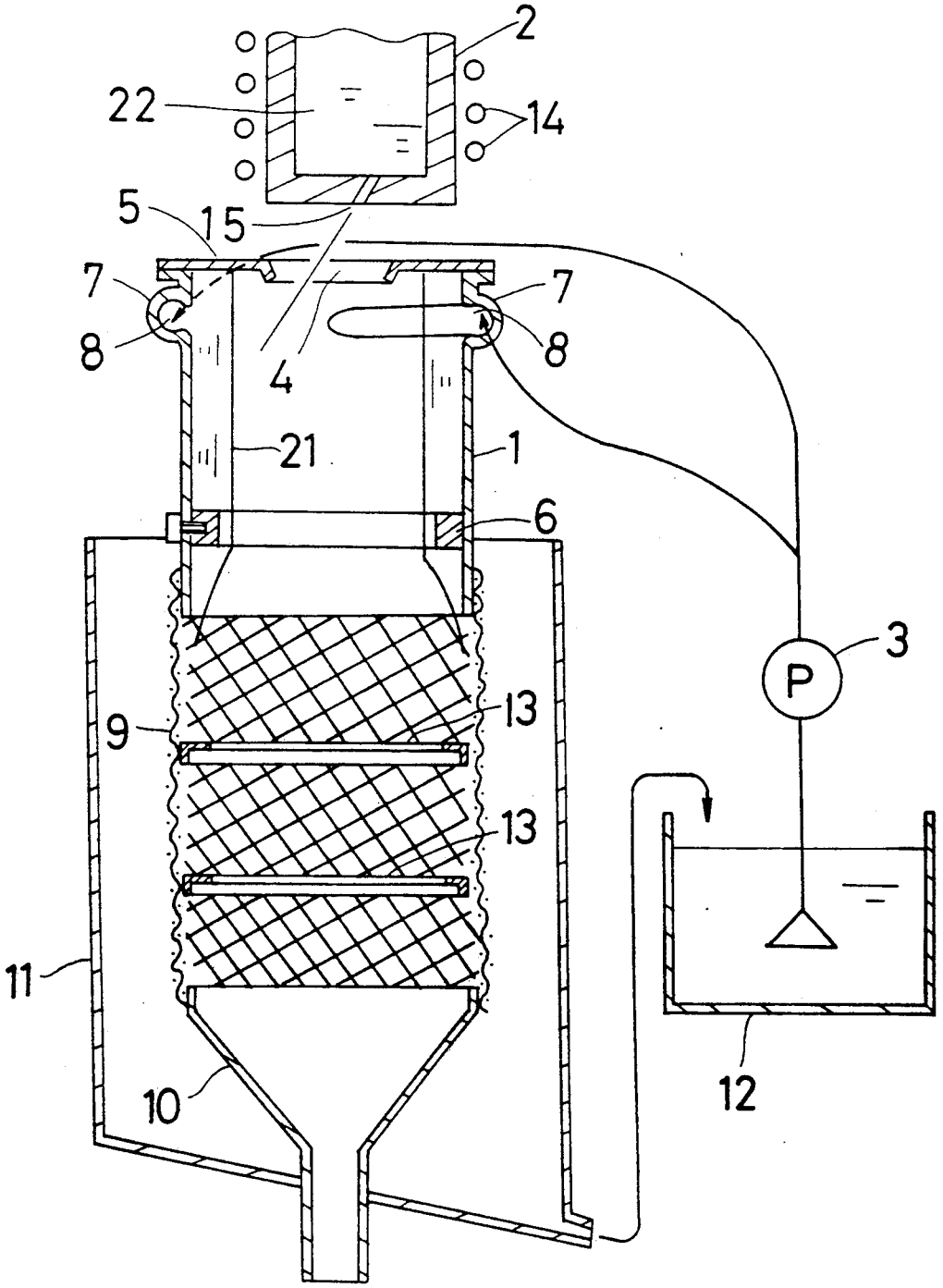
FIG. 2 is a fragmentary diagram in section of another embodiment having a liquid removing net with flow retarding buffer flanges attached thereto.

To achieve effective primary removal of the liquid by the net 9, it is desirable to attach a plurality of (e.g., two) flow retarding buffer flanges 13 to the inner periphery of the net 9 removably with bolts or the like as seen in FIG. 2. The flanges 13 reduce the speed of downward flow of the cooling liquid to drain the powder for a longer period of time and make it possible to effectively utilize the energy of downward flow as rotational energy in the circumferential direction for efficient centrifugal removal of the liquid.

With the apparatus of FIG. 1, the outlets 8 of the liquid injection pipes 7 have their openings at the upper portion of the cooling cylinder 1. When the thickness adjusting ring 6 is positioned at a large distance from the injection pipes 7, an increase in the downward flow speed of the cooling liquid is liable to recess the middle portion of the cooling liquid layer 21, so that the outlets 8 are positioned preferably between the upper surface of the ring 6 and the midportion between the upper end of the cylinder 1 and the upper surface of the ring 6. Even when the outlets 8 are so positioned, the cooling liquid portion above the outlets 8 is forced upward by the action of a centrifugal force to form a liquid layer having approximately the same definite thickness as the liquid layer below the outlets.

Figure 3:
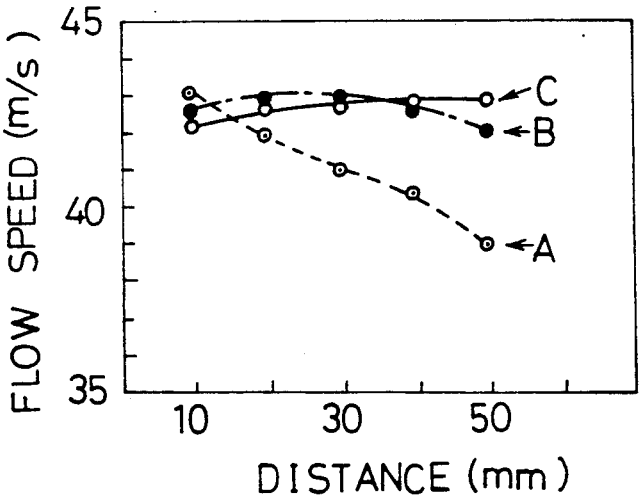
FIG. 3 is a graph showing the relationship between the flow speed of a cooling liquid layer and the distance of the outlets of cooling liquid injection pipes from the upper end of a cylinder when the pipe outlets are shifted.

FIG. 3 shows the results obtained by measuring the flow speed of the cooling liquid layer when the vertical distance from the upper end of the cylinder 1 to the center of outlet 8 of each injection pipe 7 was set to A=10 mm, B=25 mm and C=44.5 mm. The cooling liquid used was water. The cylinder 1 was 100 mm in inside diameter, the distance from the upper end of the cylinder 1 to the upper surface of the ring 6 was 50 mm, the ring 6 was 55 mm in inside diameter, and the outlet was 11 mm in diameter.

The diagram reveals that the flow speed remained almost unchanged when the outlet 8 was at the position of B or C, and the liquid layer 21 had a stabilized inside diameter of about 55 mm. In contrast, when the outlet 8 was at the position of A, the flow speed decreased downwardly of the cylinder, and the inside diameter of the liquid layer 21 gradually increased from the position A toward a location above the position C, with a slight decrease in the thickness of the layer at its midportion.

Next, embodiments will be described below which are adapted to readily form a stabilized cooling liquid layer. Throughout the drawings showing the embodiments of the invention, like parts are designated by like reference numerals.

Figure 4:
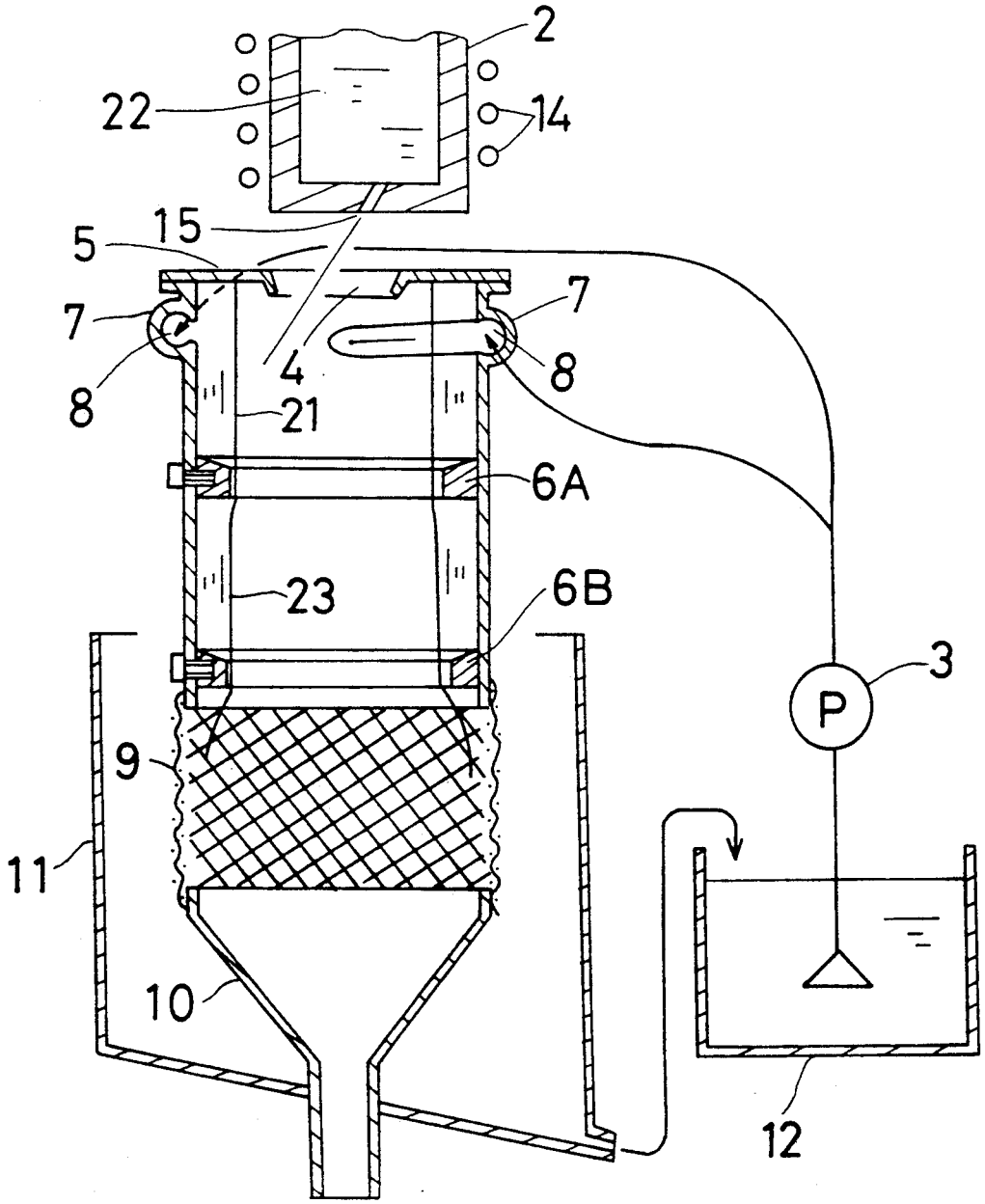
FIG. 4 is a fragmentary diagram in section of another embodiment having a plurality of rings for adjusting the thickness of the layer.

The metal powder producing apparatus shown in FIG. 4 has thickness adjusting rings 6A and 6B arranged at two different levels on the inner periphery of the cooling cylinder 1. Each of these rings 6A and 6B has a tapered upper surface having a diameter decreasing downward. The inside diameter of the lower ring 6B is equal to or slightly larger than the inside diameter of the upper ring 6A. Preferably, the distance between the upper and lower rings 6A, 6B is about one to about three times the distance from the upper end of the cylinder 1 to the upper ring 6A. The distance from the upper end of the cylinder 1 to the upper ring 6A, which varies with the inside diameter of the cylinder and the amount and speed of cooling liquid to be injected, is so determined that the liquid layer 21 obtained has an approximately constant inside diameter.

Figure 5:
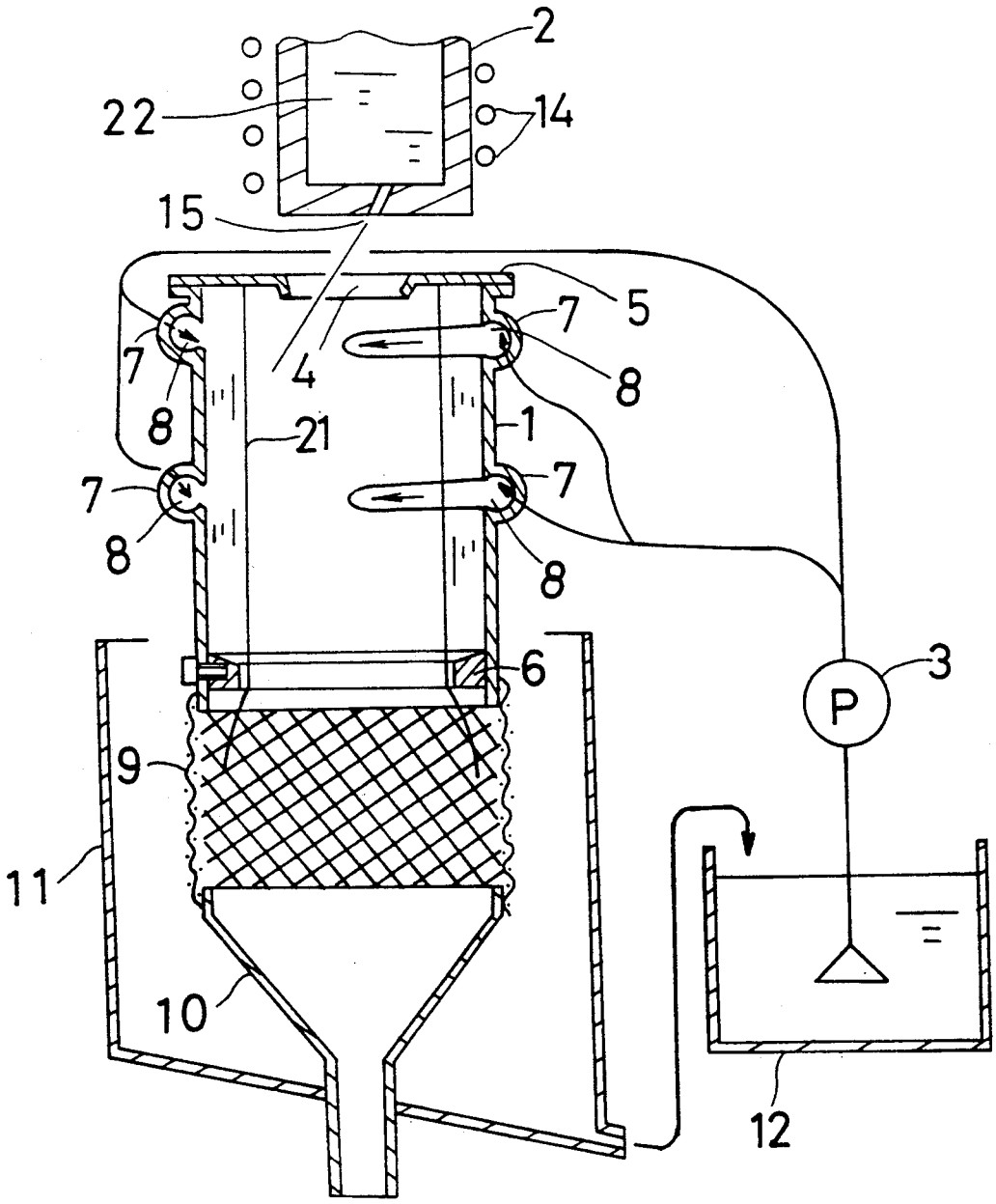
FIG. 5 is a fragmentary diagram in section of another embodiment having cooling liquid injection pipes in a plurality of stages.

According to the present embodiment, the upper ring 6A serves to regulate the downward flow speed of the cooling liquid and to effectively utilize the energy of downward flow as circumferential rotational energy. This diminishes the decrease in the thickness of the cooling liquid layer 21 that would result from an increase in the downward flow speed of the cooling liquid, making it possible for a relatively small amount of cooling liquid to readily form on the inner periphery of the cylinder 1 the liquid layer 21 having an approximately uniform inside diameter and a constant speed of revolution for pulverization and cooling. Further the lower ring 6B forms another cooling liquid layer 23 positioned below and joined to the upper liquid layer 21 for the layer 23 to fully cool the powder. Although FIG. 4 shows two thickness adjusting rings as arranged one above the other, such rings may be provided in more than two stages The apparatus of FIG. 5 has cooling liquid injection pipes 7, the outlets 8 of which are formed in the inner periphery of the cooling cylinder 1 and arranged in a plurality of stages at different levels. Although the number of stages of and the spacing between liquid injection pipes 7 vary with the amount and pressure of cooling liquid to be injected, the position of the thickness adjusting ring 6, etc., such pipes 7 are arranged in a suitable number of stages which are approximately equidistantly spaced apart so as to form a cooling liquid layer 21 having an approximately uniform inside diameter. Incidentally, a plurality of liquid injection pipes 7 are arranged symmetrically in each stage.

Figure 6:
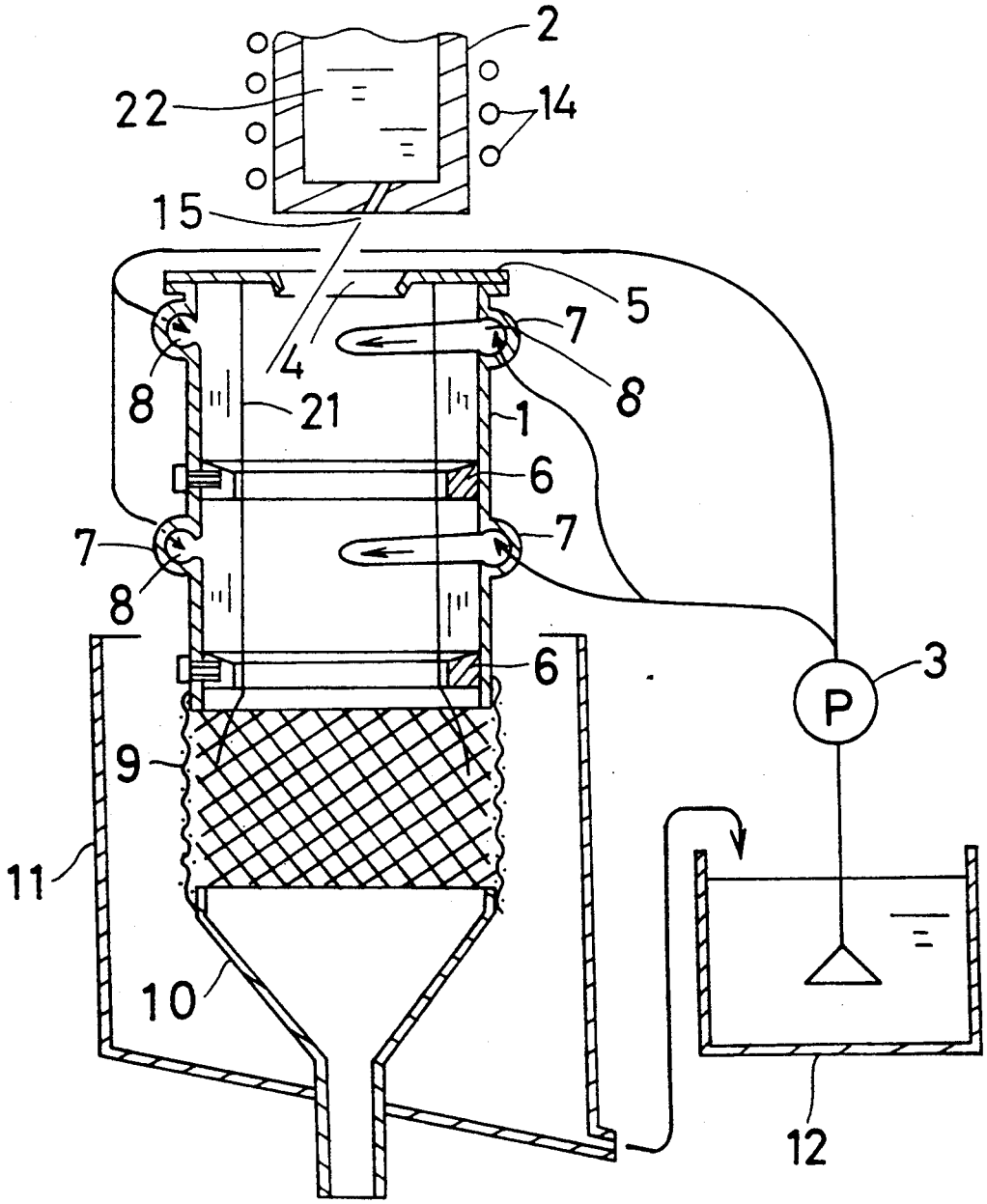
FIG. 6 is a fragmentary diagram in section of another embodiment having cooling liquid injection pipes, as well as thickness adjusting rings, in a plurality of stages.

With the present embodiment, the liquid injection pipes 7 are provided in the plurality of stages above the thickness adjusting ring 6. This prevents the decrease in the thickness of the liquid layer 21 that would occur above the ring 6 owing to an increase in the downward flow speed of the cooling liquid, with the result that the cooling liquid layer 21 having a uniform inside diameter and a constant speed of revolution can be readily formed on the inner peripheral surface of the cylinder 1 over a long area. Further as seen in FIG. 6, another thickness adjusting ring 6 may be provided between the adjacent stages of the liquid injection pipes 7, whereby higher stability can be given to the thickness and the flow speed of the cooling liquid layer 21.

Figure 7:
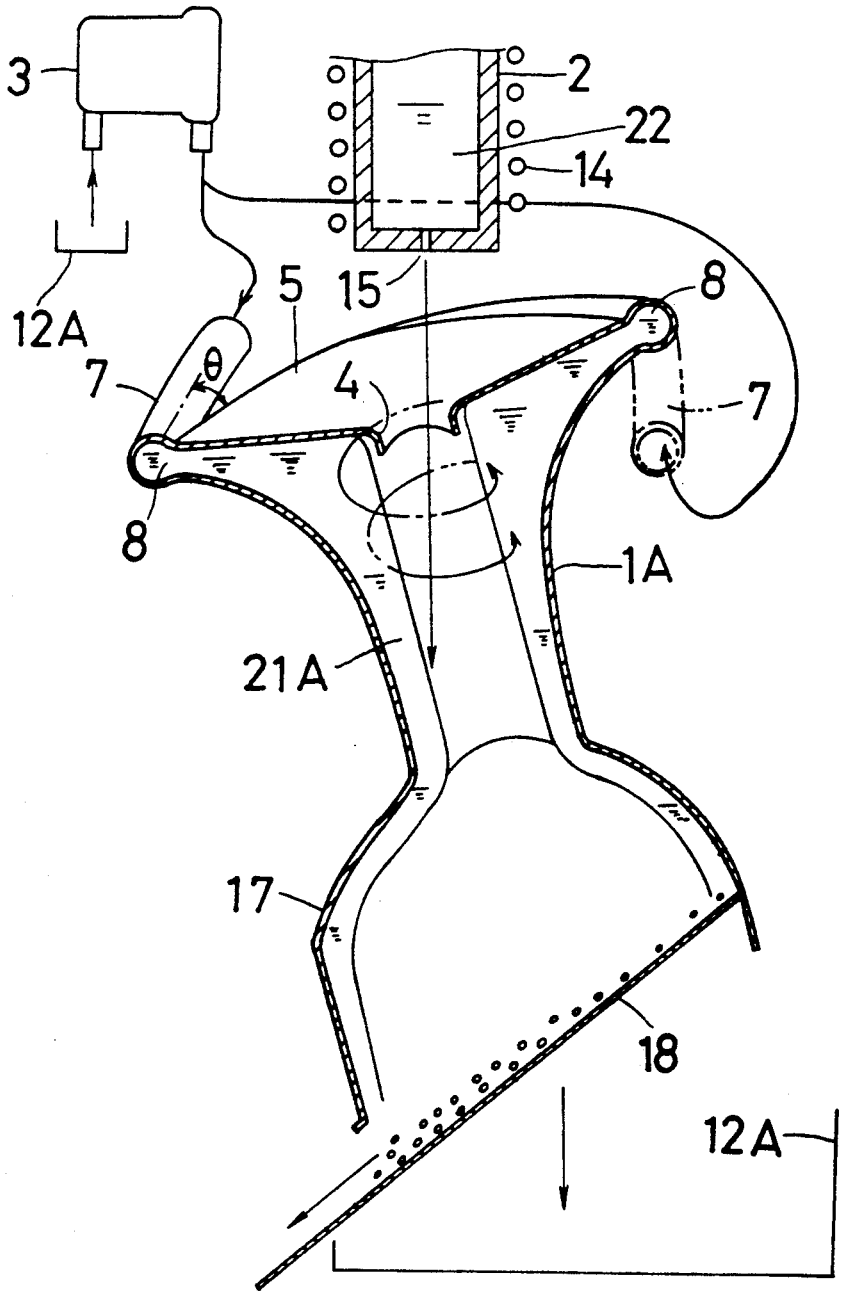
FIG. 7 is a fragmentary diagram in section of another embodiment having a funnel-shaped cooling cylinder.

Although the cooling cylinder 1 described is hollow and circular in cross section and has a vertical axis, the hollow cylinder may alternatively be in the form of a funnel-shaped tubular body 1A and having a diameter gradually decreasing downward and an inclined axis as shown in FIG. 7. The funnel-shaped tubular body 1A has the advantage that a cooling liquid layer 21A of uniform thickness can be formed over the inner surface of the body without using any thickness adjusting ring.

The tubular body 1A of FIG. 7 includes at its lower end a diametrically enlarged tubular portion 17 and has an axis which is suitably inclined at an angle. The tubular portion 17 is provided at its bottom with a slanting mesh member 18 for passing the cooling liquid therethrough downward and separating off a metal powder. The cooling liquid passing through the mesh member 18 is collected by a tank 12A and recycled for use.

The molten metal 22 in the injection crucible 2 shown in FIG. 7 may be discharged through a nozzle orifice 15 and allowed to flow down under gravity. In the case where the hollow cylinder is inclined, the molten metal may similarly be discharged through the nozzle orifice and allowed to flow down into the cooling liquid layer under gravity without being pressurized by a pressure medium. Alternatively, the tubular body 1A may be installed upright to inject the molten metal 22 obliquely into the cooling liquid layer 21A with a pressure medium supplied to the injection crucible 2. The radius r of the inner peripheral surface of the tubular body 1A as measured from the axis of the body is to be determined, for example, from the equation given below wherein y is a dimension measured from the upper end of the tubular body 1A along its axis downward as a positive value, and $C_1$ and $C_2$ are constants. Further the inclination $\theta$ of the cooling liquid injection pipe 7 with respect to a plane intersecting the axis of the tubular body 1A at right angles therewith is about 0 to about 20 degrees as already stated.

$$r = \frac{C_1}{\sqrt{y}} + C_2$$

Figure 8:
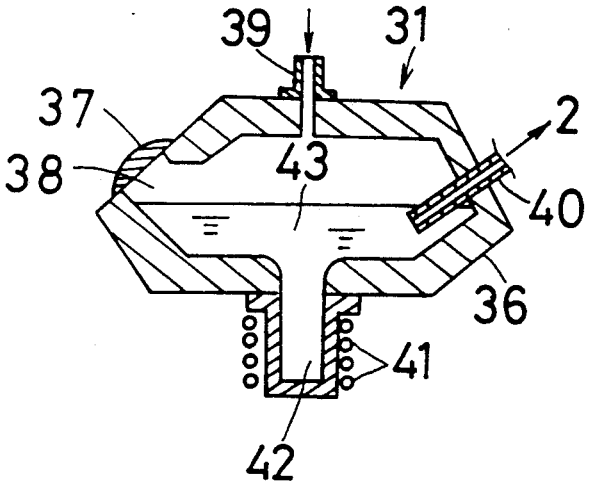
FIG. 8 is a diagram in section cf a device for continuously pouring a molten metal.
Figure 9:
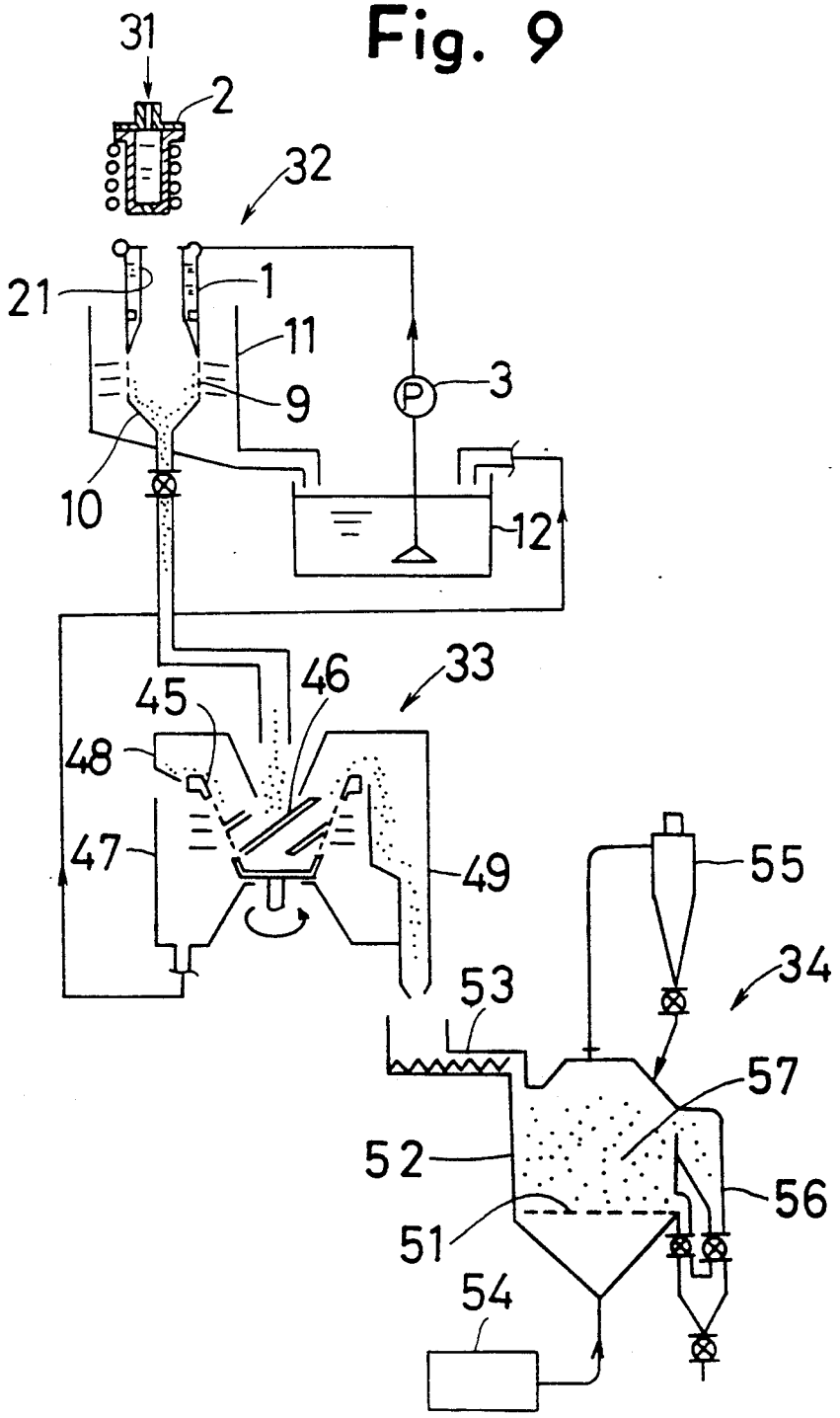
FIG. 9 is a diagram showing an arrangement of equipment for continuously producing a metal powder.
Figure 10:
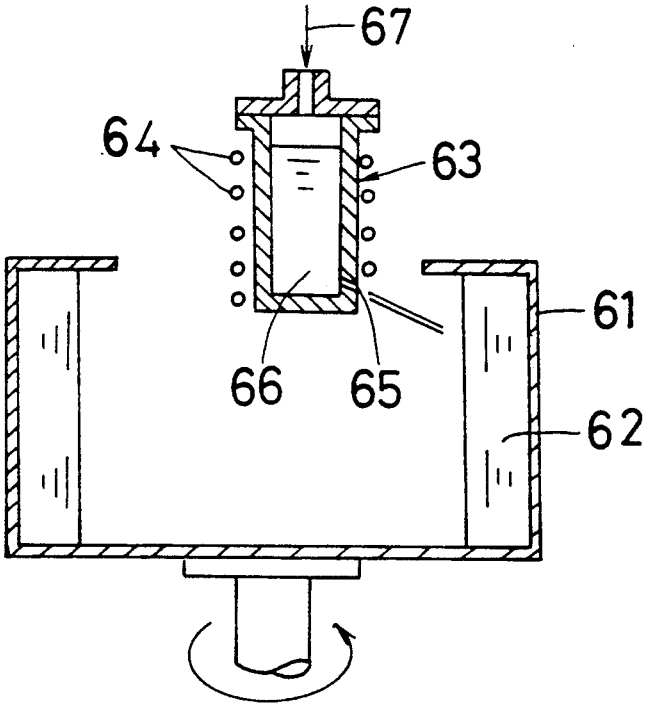
Fig. 10 PRIOR ART
FIG. 10 is a fragmentary diagram in section of a conventional apparatus for producing a metal powder.

FIGS. 8 and 9 are diagrams showing the overall construction of an example of equipment for continuously producing a metal powder. The equipment includes the metal powder production apparatus described and adapted to supply a molten metal, produce the powder therefrom and drain and dry the powder by a continuous operation. The molten metal forced out from a continuous molten metal pouring device 31 is passed through the powder production apparatus 32, a continuous liquid removing unit 33 and a continuous drying unit 34 and thereby made into a finished product of metal powder.

The continuous molten metal pouring device 31 comprises a container 36 formed by a refractory heat-insulating material. The container 36 has a melt feed inlet 38 closable with a closure 37, a pipe 39 for supplying an inert gas or like pressure medium, and a pipe 40 for discharging the molten metal 43 from the container 36, and is formed at its bottom with a recessed portion 42 having an induction heating coil 41. The temperature of the molten metal 43 within the container 36 is controlled by the coil 41. The metal is forced into the injection crucible 2 of the production apparatus 32 through the discharge pipe 40 by the inert gas, such as argon gas, injected into the container via the supply pipe 39. The discharge pipe 40 is heat-insulated by suitable means such as a heat-insulating layer or induction heater.

The metal powder prepared by the production apparatus 32 is placed into the liquid removing net 9 for the primary removal of liquid, then fed along with the remaining portion of liquid into the liquid removing unit 33 via the powder collecting funnel 10 and centrifugally separated from the liquid. The liquid removing unit 33 has an upwardly flaring rotary drum 45. The peripheral wall of an intermediate portion of the drum 45 is formed by a screen plate having a multiplicity of minute openings. The drum is formed on its inner peripheral surface with many projecting ribs 46, whereby the powder separated from the liquid is delivered upward. A liquid collecting cover 47 is provided around the rotary drum 45. The cooling liquid removed is collected in the tank 12 through a bottom portion of the cover. A powder collecting cover 48 is provided over the rotary drum 45 and has a discharge chute 49 attached thereto.

The wet metal powder discharged through the chute 49 of the liquid removing unit 33 is subsequently fed to the drying unit 34. This unit 34 comprises a drying container 52 having a fluidizing member 51 formed with a multiplicity of minute openings, a feed device 53 having a rotary feeder for supplying the wet material to the upper portion of the container 52, a hot air generator 54 for supplying hot air to the lower portion of the container 52, and a cyclone 55 for collecting fine particles from the hot air discharged from the top of the container 52. A discharge pipe 56 is attached to the side wall of the container 52 at the upper and lower portions thereof.

A fluidized bed 57 is formed within the drying container 52. The wet metal powder is vigorously mixed with the hot air within the fluidized bed 57, rapidly dried through heat exchange, and delivered from the container 52 via the discharge pipe 56 usually by being allowed to overflow the side wall.

The continuous molten metal pouring device, continuous liquid removing unit and continuous drying unit to be used for practicing the present invention are not limited to those described above, but suitable means commercially available are also usable.

What is claimed is:

1. An apparatus for producing a metal powder characterized in that the apparatus comprises:
   - a cooling tubular body provided with a liquid injection pipe for injecting a cooling liquid onto an inner circumference of the tubular body in a direction tangential to the circumference;
   - injector means including a nozzle orifice for injecting a molten metal stream, said nozzle being directed to a cooling liquid layer formed of the cooling liquid; and
   - liquid feeding means for feeding the cooling liquid to the liquid injection pipe.

2. An apparatus as defined in claim 1 wherein the cooling tubular body is a hollow cylinder.

3. An apparatus as defined in claim 2 and further including a ring for adjusting the thickness of the cooling liquid layer provided on the inner periphery of the cooling tubular body.

4. An apparatus as defined in claim 3 wherein the liquid injection pipe has its outlet positioned between the upper surface of the thickness adjusting ring and the midportion between the upper end of the tubular body and the upper surface of the ring.

5. An apparatus as defined in claim 3 and further including a plurality of rings provided for adjusting the thickness of the cooling liquid layer.

6. An apparatus as defined in claim 1 and further including cooling liquid injection pipes provided in a plurality of stages above the thickness adjusting ring.

7. An apparatus as defined in claim 6 wherein the thickness adjusting ring is provided between the adjacent stages of liquid injection pipes.

8. An apparatus as defined in any one of claims 1, 3, 4, 5, 6 and 7 and further including a liquid removing tubular net attached to the lower end of the cooling tubular body.

9. An apparatus as defined in claim 1 wherein the cooling tubular body is in the form of a funnel.

10. An apparatus for producing a metal power characterized in that the apparatus comprises:
   - a hollow cylindrical cooling tubular body provided with a liquid injection pipe for injecting a cooling liquid onto an inner circumference of the tubular body in a direction tangential to the inner circumference;
   - injector means for injecting a molten metal into a cooling liquid layer formed over the inner circumferential surface of the tubular body by the cooling liquid injected from the liquid injection pipe;
   - feed means for feeding the cooling liquid to the liquid injection pipe; and
   - a ring for adjusting the thickness of the cooling liquid layer, said ring being provided on the inner periphery of the cooling tubular body.

11. An apparatus as defined in claim 10, wherein the liquid injection pipe has its outlet positioned between the upper surface of the thickness adjusting ring and the midportion between the upper end of the tubular body and the upper surface of the ring.

12. An apparatus as defined in claim 10, and further including a plurality of rings provided for adjusting the thickness of the cooling liquid layer.

13. An apparatus as defined in claim 10, and further including cooling liquid injection pipes provided in a plurality of stages above the thickness adjusting ring.

14. An apparatus as defined in claim 13, wherein the thickness adjusting ring is provided between the adjacent stages of liquid injection pipes.

15. An apparatus as defined in claim 10, and further including a liquid removing tubular net attached to the lower end of the cooling tubular body.

* * * * *